US008631656B2

(12) United States Patent
Danis et al.

(10) Patent No.: US 8,631,656 B2
(45) Date of Patent: Jan. 21, 2014

(54) GAS TURBINE ENGINE COMBUSTOR CIRCUMFERENTIAL ACOUSTIC REDUCTION USING FLAME TEMPERATURE NONUNIFORMITIES

(75) Inventors: Allen Michael Danis, Mason, OH (US); Mark Anthony Mueller, West Chester, OH (US); Timothy James Held, Blanchester, OH (US); Steven Marakovits, Mason, OH (US)

(73) Assignee: General Electric Company, Schenectady, NY (US)

( * ) Notice: Subject to any disclaimer, the term of this patent is extended or adjusted under 35 U.S.C. 154(b) by 978 days.

(21) Appl. No.: 12/059,256

(22) Filed: Mar. 31, 2008

(65) Prior Publication Data

US 2009/0241548 A1 Oct. 1, 2009

(51) Int. Cl.
*F23R 3/34* (2006.01)
*F02C 7/236* (2006.01)

(52) U.S. Cl.
USPC ..... 60/746; 60/747; 60/734; 60/725

(58) Field of Classification Search
USPC ..... 60/737, 746, 747, 748, 739, 804, 734, 60/725; 431/114
See application file for complete search history.

(56) References Cited

U.S. PATENT DOCUMENTS 2,720,752 A * 10/1955 Chandler et al. ..... 60/39.281
2,742,755 A * 4/1956 Coleman et al. ..... 60/241
3,921,390 A * 11/1975 Stoltman ..... 60/39.27
5,097,666 A * 3/1992 Shekleton et al. ..... 60/737
5,259,184 A 11/1993 Borkowicz et al.
5,303,542 A 4/1994 Hoffa
5,491,970 A 2/1996 Davis, Jr. et al.
5,685,157 A 11/1997 Pandalai et al.
5,943,866 A 8/1999 Lovett et al.
6,973,791 B2 12/2005 Handelsman et al.

(Continued)

FOREIGN PATENT DOCUMENTS

DE 10325455 A1 6/2003
DE 102004015186 3/2004
WO WO2004109188 A1 12/2004
WO WO2005093326 A2 10/2005

OTHER PUBLICATIONS

PCT International Search Report, Mar. 9, 2010, 3 pages.

(Continued)

*Primary Examiner* — William H Rodriguez
*Assistant Examiner* — Carlos A Rivera
(74) *Attorney, Agent, or Firm* — General Electric Co.; William Scott Andes; Steven J. Rosen

(57) ABSTRACT

A gas turbine engine combustor includes an annulus with one or more circular rows of burners and a means for providing a number of equiangular spaced apart flame temperature non-uniformities around the annulus during engine operation. The number of the flame temperature nonuniformities being equal to a circumferential acoustic mode to be attenuated in the combustor (i.e three, five, or seven). Fuel lines and/or water lines in supply communication with the burners and metering orifices in a portion of the fuel lines and/or the water lines may be used to produce the flame temperature nonuniformities. The annulus of the burners may have an equal number of equiangular spaced apart first and second arcuate segments of the burners and a means for operating the burners in the first segments and operating the burners in the second segments at different first and second flame temperatures respectively.

27 Claims, 9 Drawing Sheets

(56) References Cited

U.S. PATENT DOCUMENTS

| | | | | |
|---|---|---|---|---|
| 6,983,605 | B1 * | 1/2006 | Hook et al. | 60/775 |
| 2002/0162336 | A1 * | 11/2002 | Weisenstein | 60/776 |
| 2004/0025512 | A1 | 2/2004 | Davis, Jr. et al. | |
| 2004/0154300 | A1 | 8/2004 | Woltmann | |
| 2006/0040225 | A1 | 2/2006 | Garay et al. | |
| 2007/0039329 | A1 * | 2/2007 | Abreu et al. | 60/776 |

OTHER PUBLICATIONS

JP Office Action dated Mar. 12, 2013 from corresponding JP Application No. 2011-501906.

* cited by examiner

GAS TURBINE ENGINE COMBUSTOR CIRCUMFERENTIAL ACOUSTIC REDUCTION USING FLAME TEMPERATURE NONUNIFORMITIES

BACKGROUND OF THE INVENTION

1. Field of the Invention

This invention relates generally to gas turbine engine combustors and, more particularly, to noise reduction in the combustors.

2. Description of Related Art

Air pollution concerns worldwide have led to stricter emissions standards. These standards regulate the emission of oxides of nitrogen (NOx), unburned hydrocarbons (HC), and carbon monoxide (CO) generated as a result of gas turbine engine operation. In particular, nitrogen oxide is formed within a gas turbine engine as a result of high combustor flame temperatures. Making modifications to a gas turbine engine in an effort to reduce nitrous oxide emissions often has an adverse effect on operating acoustic levels of the associated gas turbine engine.

Destructive or undesirable acoustic pressure oscillations or pressure pulses may be generated in combustors of gas turbine engines as a consequence of normal operating conditions depending on fuel-air stoichiometry, total mass flow, and other operating conditions. The current trend in gas turbine combustor design towards low NOx emissions required to meet federal and local air pollution standards has resulted in the use of lean premixed combustion systems in which fuel and air are mixed homogeneously upstream of the flame reaction region.

The fuel-air ratio or the equivalence ratio at which these combustion systems operate are much "leaner" compared to more conventional combustors in order to maintain low flame temperatures which in turn limits production of unwanted gaseous NOx emissions to acceptable levels. This method often uses water or steam injection for achieving low emissions, but the combustion instability associated with operation with water or steam injection and at low equivalence ratio also tends to create unacceptably high dynamic pressure oscillations in the combustor that can result in hardware damage and other operational problems. Pressure pulses can have adverse effects on an engine, including mechanical and thermal fatigue to combustor hardware. The problem of pressure pulses has been found to be of even greater concern in low emissions combustors since a much higher percentage of air is introduced to the fuel-air mixers in such designs.

Aircraft engine derivative annular combustion systems, such as the LM series of gas turbine engines from the General Electric Company, with their short compact combustor design have been observed to produce complex predominant acoustic pressure oscillation modes in the combustor. As an example, the LMS100 Rich-SAC (Single Annular Combustor) produces combustion dynamics when injecting water for NOx control. These combustion acoustics can be of high enough amplitude to produce HCF cracking in combustor hardware, as well as drive accelerated wear on combustor interface surfaces. The LMS100 high power, intercooled cycle produces significantly lower T3, higher fuel-air ratios and uses a higher water flow than previous marine and industrial rich-SAC engines, all of which exacerbate combustion acoustics. As a result, the LMS100 is the first M&I SAC incorporating combustion dynamics control design features.

Dry-low-emissions (DLE) combustors are more prone to combustion acoustics and typically include design features and/or control logic to reduce the severity of combustion acoustics. These include quarter wave tubes to dampen pressure fluctuations, multiple fuel systems, and supplemental fuel circuits. Multiple fuel systems allow for flame temperature variation within the combustion chamber.

The LM2500 DLE and LM6000 DLE incorporate three rings of premixers that are independently fueled. This allows for the outer, middle, and inner premixers to have different flame temperatures. The radial variation in flame temperature can be as high as several hundred degrees.

Supplemental fuel circuits have been used to inject a relatively small portion of the fuel into the combustor at different locations from the primary injection locations. The supplemental fuel may have a convective time scale, defined as the time it takes for the fuel/air mixture to travel from the point of injection to the flame front, different than that of the primary fuel source. As such, pressure waves in the combustor are unlikely to interact in the same manner with both fuel sources. This out-of-phase fluctuation in heat release serves to reduce the amplitude of the pressure fluctuations. In some implementations, the supplemental fuel also introduces temperature variation within the combustion chamber.

In the General Electric LM2500 DLE and LM6000 DLE combustors, supplemental fuel is injected from every other premixer. The fuel flow to premixers without supplemental fuel is generally lower than those with the supplemental fuel. The premixer-to-premixer flame temperature variation can be as high as several hundred degrees. It should be noted that a circumferential pattern of supplemental fuel in the LM2500 DLE and LM6000 DLE premixers is constrained by premixer design to every-other premixer.

It is highly desirable to have an effective means for eliminating or reducing these high levels of noise or acoustics in a gas turbine engine combustor, particularly, one that has a short length and is designed for low NOx (nitrous oxides), CO, and unburnt hydrocarbon emissions. It is also highly desirable for this means to be simple to employ or add to already existing engines and to tune it for specific engines and installations.

BRIEF SUMMARY OF THE INVENTION

A gas turbine engine combustor includes an annulus with one or more circular rows of burners and a means for providing a number of equiangular spaced apart flame temperature nonuniformities around the annulus during engine operation. The number of the flame temperature nonuniformities is equal to a circumferential acoustic mode to be attenuated in the combustor during engine operation. In an exemplary embodiment of the combustor, the number of the flame temperature nonuniformities is equal to three, five, or seven. The combustor may have one, two, or three of the circular rows of burners.

Another more particular embodiment of the combustor includes fuel lines in fuel supply communication with the burners and metering orifices in a portion of the fuel lines for producing the flame temperature nonuniformities. Water lines may also be in supply communication with the burners and the metering orifices may be in a portion of the fuel lines and/or the water lines. One embodiment of the combustor may have one, two, or three of the circular rows of burners.

Another more particular embodiment of the combustor includes an annulus of burners having one or more circular rows of the burners and the annulus comprising an equal number of equiangular spaced apart first and second arcuate segments of the burners. A means is provided for operating the first segments of the burners at a first flame temperature and operating the second segments of the burners at a second flame temperature different than the first flame temperature. The first segments of the burners have a smaller quantity of the burners than the second segments of the burners. The number of the first segments is equal to a circumferential acoustic mode to be attenuated in the combustor during engine operation. The number of the first segments may be three, five, or seven.

A method for attenuating circumferential acoustics in a gas turbine engine combustor includes operating the combustor with a number of equiangular spaced apart flame temperature nonuniformities around an annulus of burners in the combustor. The annulus includes one or more circular rows of burners and the number of the flame temperature nonuniformities is equal to a circumferential acoustic mode to be attenuated in the combustor during engine operation.

The number of the flame temperature nonuniformities may be equal to three, five, or seven and the combustor having one, two, or three of the circular rows of burners.

The method may include operating the first segments of the burners at a first flame temperature and operating the second segments of the burners at a second flame temperature different than the first flame temperature. One more particular embodiment of the method includes flowing fuel through fuel lines to carburetors of the burners and wherein the fuel lines to the carburetors of the burners in the first segments have metering orifices disposed therein. Another more particular embodiment of the method includes flowing fuel through fuel lines to carburetors of the burners, flowing water through water lines to carburetors of the burners, and wherein the fuel lines and/or the water lines have metering orifices disposed therein.

BRIEF DESCRIPTION OF THE DRAWINGS

The foregoing aspects and other features of the invention are explained in the following description, taken in connection with the accompanying drawings where.

DETAILED DESCRIPTION OF THE INVENTION

Figure 1:
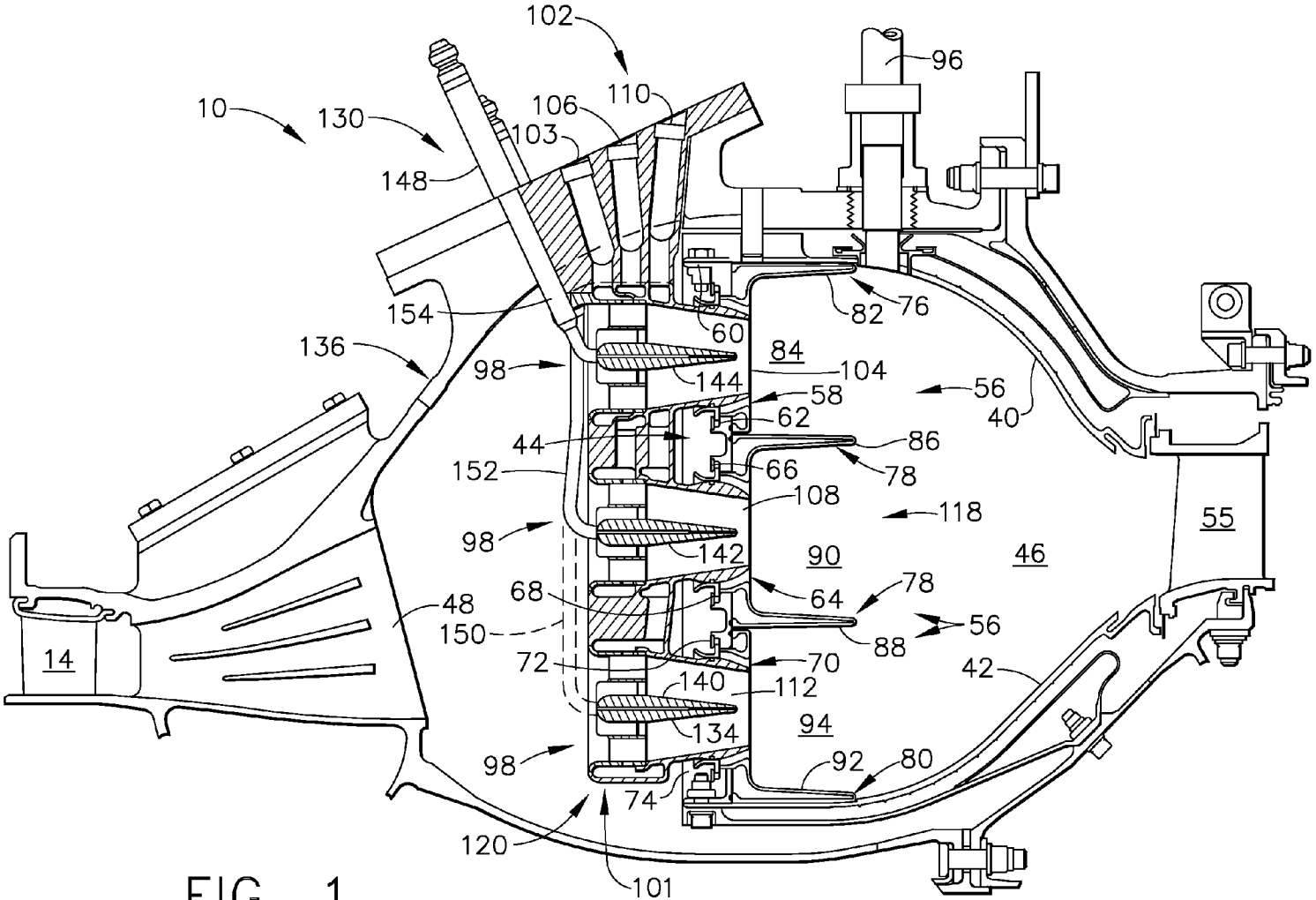
FIG. 1 is a cross-sectional view illustration of a gas turbine engine combustor with an array of fuel burners for operating with number of circumferential flame temperature nonuniformities.

Referring now to the drawings in detail, wherein identical numerals indicate the same elements throughout the figures. FIG. 1 illustrates a combustion section or gas turbine engine combustor 10 disposed between a diffuser 48 downstream of a stage of compressor outlet guide vanes 14, and a turbine nozzle 55. The combustor 10 is a type suitable for use in a gas turbine engine and, in particular, for a low NOx marine/industrial gas turbine engine. Combustor 10 is a triple annular combustor designed to produce low emissions as described in more detail in U.S. Pat. No. 5,323,604, also owned by the assignee of the present invention and hereby incorporated by reference.

The combustor 10 includes an annular outer liner 40, an annular inner liner 42, and a domed end 44 extending between outer and inner liners 40 and 42, respectively. Outer liner 40 and inner liner 42 are spaced radially inward from an outer combustor casing 136 defining a combustion chamber 46 therebetween. Combustor casing 136 is generally annular and extends downstream from a diffuser 48. Combustion chamber 46 is generally annular in shape and is disposed radially inward from liners 40 and 42. Outer and inner liners 40 and 42 extend axially downstream to the turbine nozzle 55 disposed downstream from the diffuser 48.

The combustor domed end 44 includes a plurality of domes 56 arranged in a triple annular configuration. Alternatively, combustor domed end 44 may include a double or singular annular configuration. It should be understood, however, that the equiangular spaced apart flame temperature nonuniformities, discussed below, incorporated in the combustor 10 is not limited to such an annular configuration and may be employed with in a gas turbine engine combustor of the well-known cylindrical can or cannular type. An outer dome 58 includes an outer end 60 fixedly attached to combustor outer liner 40 and an inner end 62 fixedly attached to a middle dome 64. The middle dome 64 includes an outer end 66 attached to outer dome inner end 62 and an outer dome inner end 68 attached to an inner dome 70. The middle dome 64 is radially disposed between the outer and inner domes 58 and 70, respectively. The inner dome 70 includes an outer end 72 attached to middle dome inner end 68 and an inner end 74 fixedly attached to combustor inner liner 42.

The combustor domed end 44 also includes a outer dome heat shield 76, a middle dome heat shield 78, and an inner dome heat shield 80 to insulate each respective dome 58, 64, and 70 from flames burning in combustion chamber 46. The outer dome heat shield 76 includes an annular endbody 82 to insulate combustor outer liner 40 from flames burning in an outer primary combustion zone 84. The middle dome heat shield 78 includes annular centerbodies 86 and 88 to segregate middle dome 64 from outer and inner domes 58 and 70, respectively. The middle dome centerbodies 86 and 88 are disposed radially outwardly from a middle primary combustion zone 90. The inner dome heat shield 80 includes an annular endbody 92 to insulate combustor inner liner 42 from flames burning in an inner primary combustion zone 94. An igniter 96 extends through the outer combustor casing 136 and is disposed downstream from the outer dome heat shield endbody 82.

The outer, middle, and inner domes 58, 64, and 70 support an annular array or annulus 118 of burners 120 having carburetors 98 that are supplied with fuel and air via premixers 101 with premixer cups fed from an assembly manifold system (not shown). A plurality of fuel tubes 102 extend between a fuel source (not shown) and the carburetors 98 in the domes 56. Specifically, outer dome fuel tubes 103 supply fuel to outer premixer cups 104 disposed within the outer dome 58, middle dome fuel tubes 106 supply fuel to middle premixer cups 108 disposed within the middle dome 64, and inner dome fuel tubes 110 supply fuel to inner premixer cups 112 disposed within inner dome 70.

The exemplary gas turbine engine illustrated herein also includes a water delivery system 130 to supply water to water injection nozzles 134 in the carburetors 98 of the burners 120 for injecting water into the combustor 10. The water delivery system 130 includes a plurality of inner, middle, and outer water injection nozzles 140, 142, and 144 in the carburetors 98 connected to a water source (not shown) by water lines 148 illustrated in FIG. 1 as inner, middle, and outer water injection lines 150, 152, and 154 respectively. The inner, middle, and outer water injection water injection nozzles 140, 142, and 144 are in flow communication with the inner, middle, and outer premixer cups 104, 108, and 112 respectively and are operable to inject an atomized water spray into the fuel/air mixture created in the premixer cups. In an alternative embodiment, the water injection nozzles 134 are connected to a steam source (not shown) and steam is injected into the fuel/air mixture using the water injection nozzles 134.

Dynamic pressure pulses or combustion acoustics or noise associated with the operation of the combustor 10 impose excessive mechanical stress on the gas turbine engine. Combustion dynamics when injecting water for NOx control has been observed to produce combustion acoustics that can have a high enough amplitude to produce HCF cracking in combustor hardware, as well as drive accelerated wear on combustor interface surfaces. The current trend in gas turbine combustor design towards low NOx emissions required to meet federal and local air pollution standards has resulted in the use of premixed combustion systems in which fuel and air and sometimes water are mixed homogeneously upstream of the flame reaction region using the relatively open flow type of swirl mixers. The fuel-air ratio or the equivalence ratio at which these combustion systems operate are much "leaner" compared to conventional combustors to maintain low flame temperatures to limit the gaseous NOx emissions to the required level. Although this method of achieving low emissions with or without the use of water or steam injection is widely used, the combustion instability associated with operation at low equivalence ratio also creates unacceptably high dynamic pressure oscillations in the combustor resulting in hardware damage and other operational problems.

Figure 2:
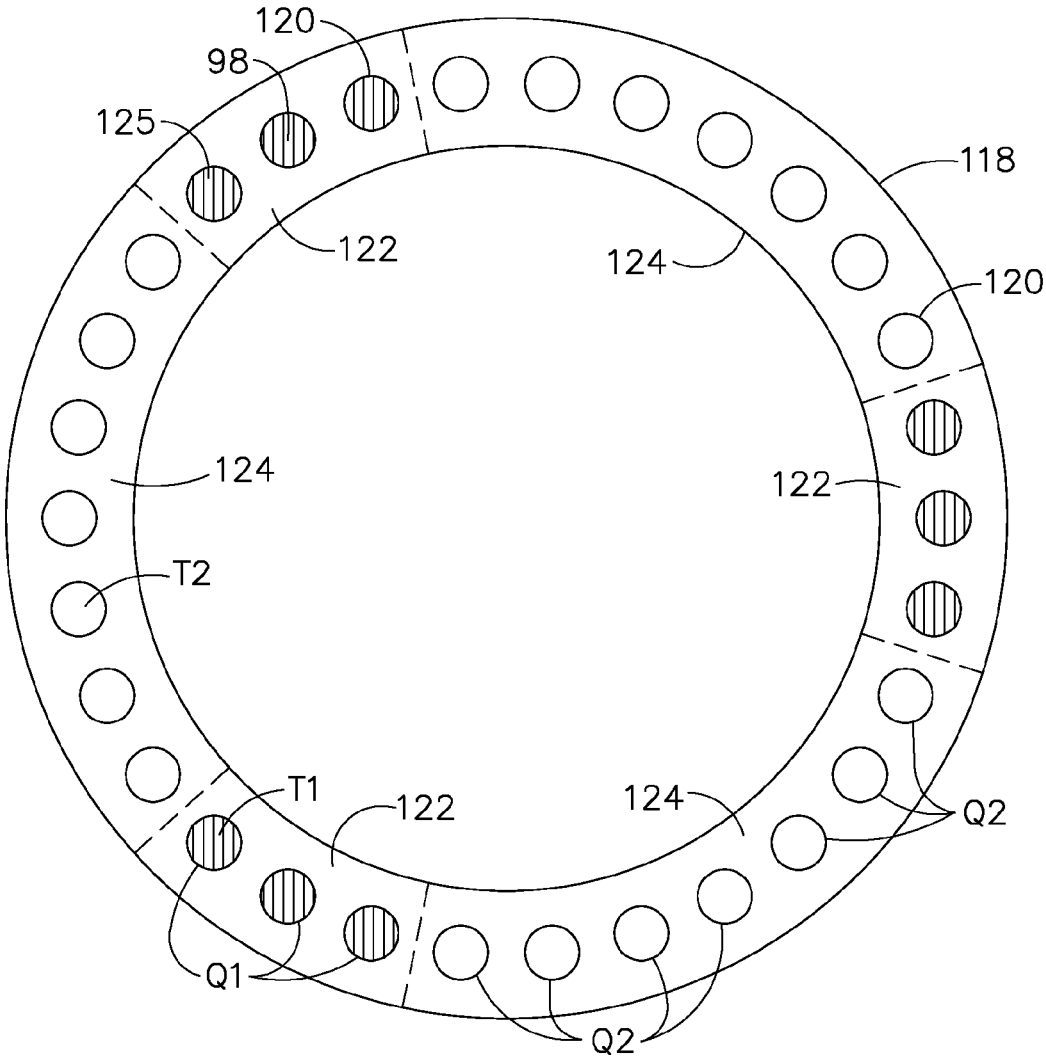
FIG. 2 is a schematical illustration of a first array of carburetors in burners to reduce or eliminate acoustics for a 3 per rev frequency in a gas turbine engine combustor with a single annular ring of fuel injectors.
Figure 3:
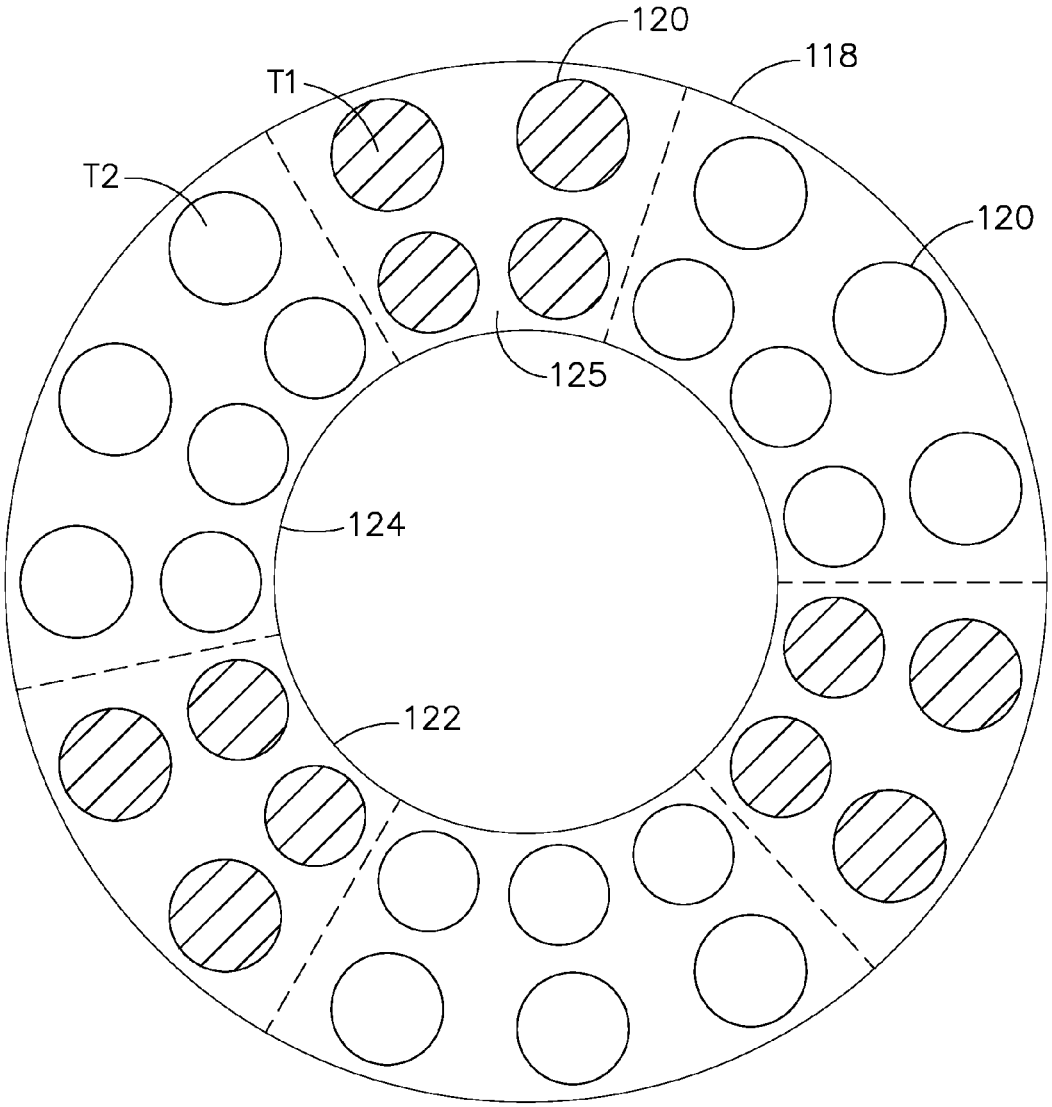
FIG. 3 is a schematical illustration of a second array of carburetors in burners to reduce or eliminate acoustics for a 3 per rev frequency in a gas turbine engine combustor with two annular rings of fuel injectors.
Figure 4:
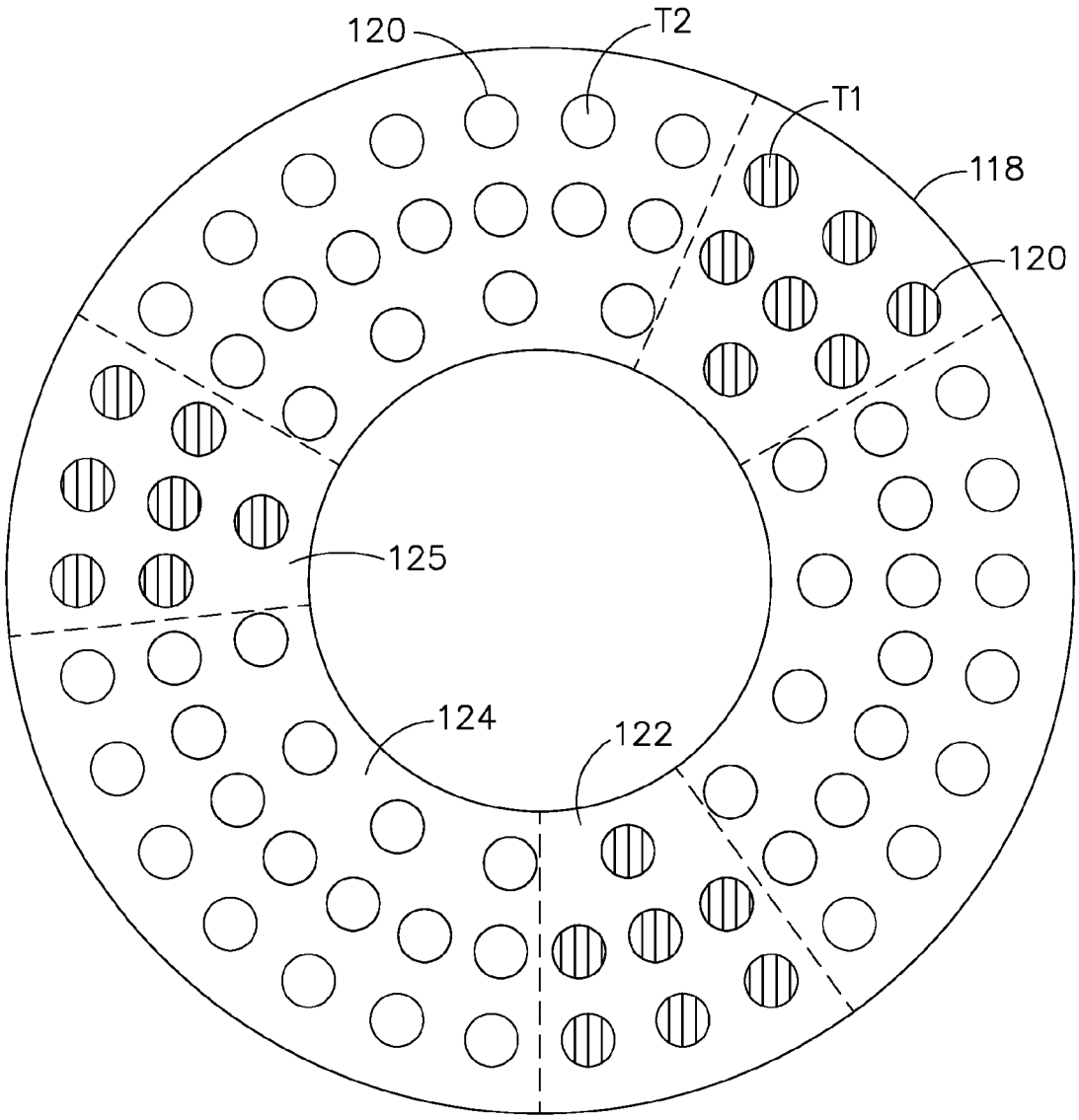
FIG. 4 is a schematical illustration of a third array of carburetors in burners to reduce or eliminate acoustics for a 3 per rev frequency in a gas turbine engine combustor with three annular rings of fuel injectors.

Illustrated in FIG. 2 is a first exemplary embodiment of the annular array or the annulus 118 of burners 120 having an equal number N of equiangular spaced apart first and second arcuate segments 122, 124. The first and second arcuate segments 122, 124 contain first and second quantities Q1, Q2 of the burners 120 respectively. The combustor 10 includes a means for providing equiangular spaced apart flame temperature nonuniformities 125 in the annulus 118 of burners 120. The number N of the flame temperature nonuniformities 125 is equal to a circumferential acoustic mode that is to be attenuated in the combustor during engine operation. Examples of the circumferential acoustic modes to be attenuated are three, five, or seven per revs corresponding to three, five, or seven of the flame temperature nonuniformities 125. The circumferential acoustic modes to be attenuated as illustrated herein are three and five per revs. A corresponding number of three and five flame temperature nonuniformities 125 are illustrated herein as being provided by three or five of the first segments 122 of the burners 120. FIGS. 2, 3, and 4 illustrate three flame temperature nonuniformities 125 and FIGS. 5, 6, and 7 illustrate five flame temperature nonuniformities 125.

First and second quantities Q1, Q2 of the burners 120 in the first and second segments 122, 124 respectively are unequal. The burners 120 in the first and second segments 122, 124 are operated at different first and second temperatures T1, T2 in order to attenuate circumferential mode acoustic waves present in the combustor during engine operation. The annulus 118 of burners 120 having the first and second segments 122, 124 operating at different first and second temperatures T1, T2 respectively creates a circumferential non-uniformity in flame temperature between segments within the annulus 118 of burners 120. The flame temperature non-uniformity is tuned to a specific pattern, such as three-per-rev as illustrated in FIGS. 2-4 or five-per-rev as illustrated in FIGS. 5-8. The flame temperature non-uniformity may be is tuned to a greater mode such as 7 for example. This tuning is more effective in attenuating circumferential mode acoustic waves than the past practice of introducing a different operating temperature in every other premixer or burner. The first quantity Q1 of the burners 120 is illustrated herein as being less than the second quantity Q2 of the burners 120.

Figure 5:
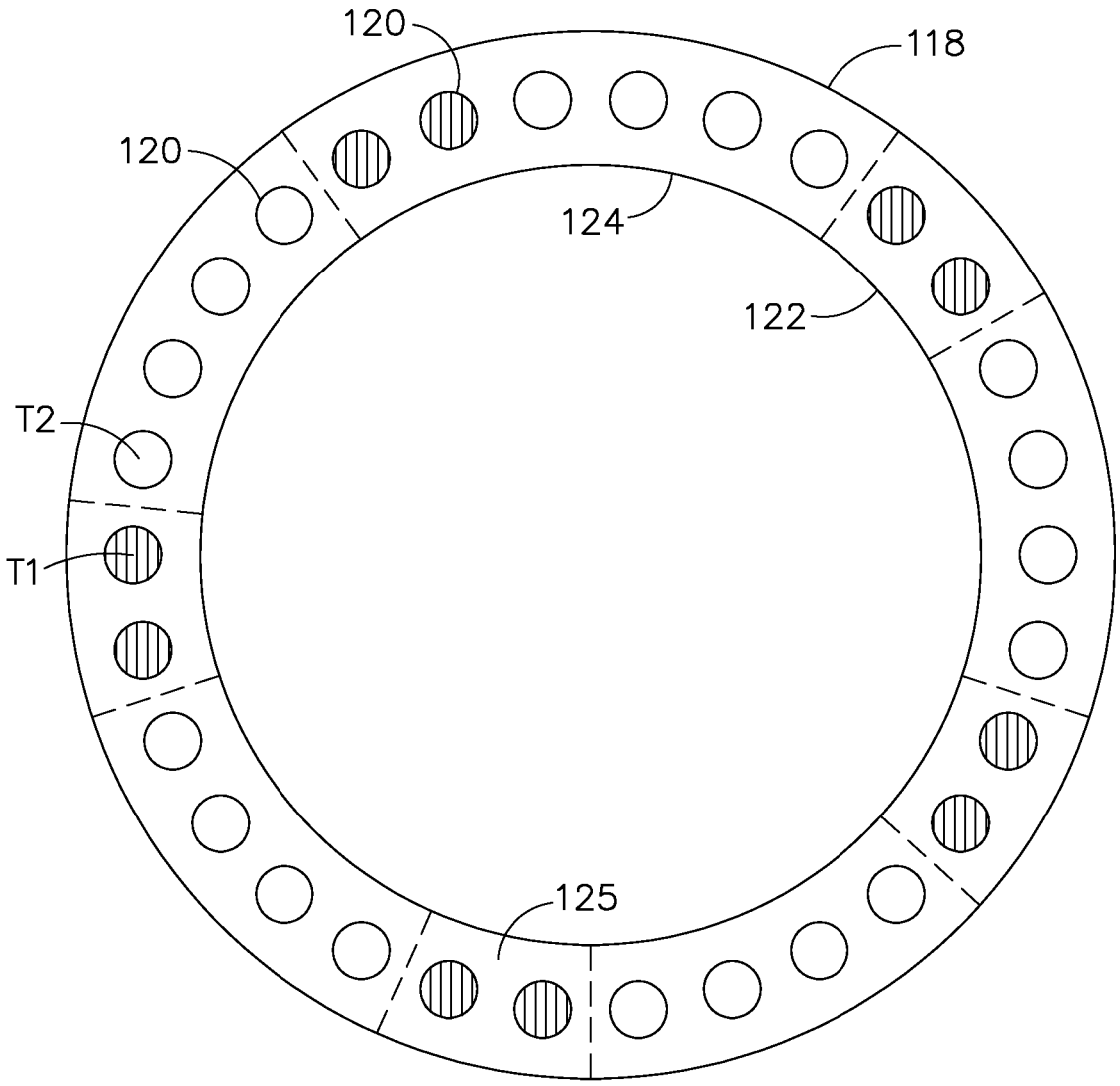
FIG. 5 is a schematical illustration of a fourth array of carburetors in burners to reduce or eliminate acoustics for a 5 per rev frequency in a gas turbine engine combustor with a single annular ring of fuel injectors.
Figure 6:
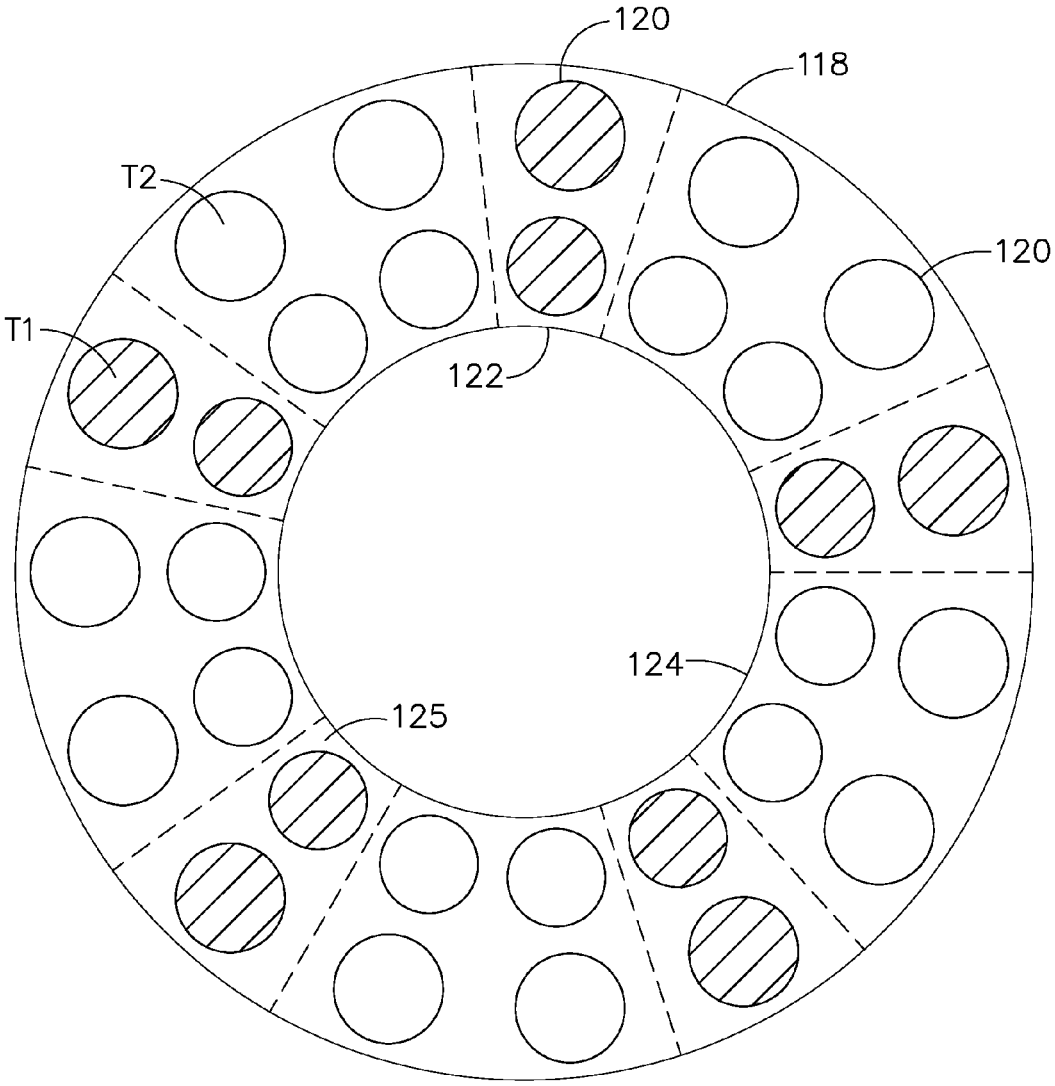
FIG. 6 is a schematical illustration of a fifth array of carburetors in burners to reduce or eliminate acoustics for a 5 per rev frequency in a gas turbine engine combustor with two annular rings of fuel injectors.
Figure 7:
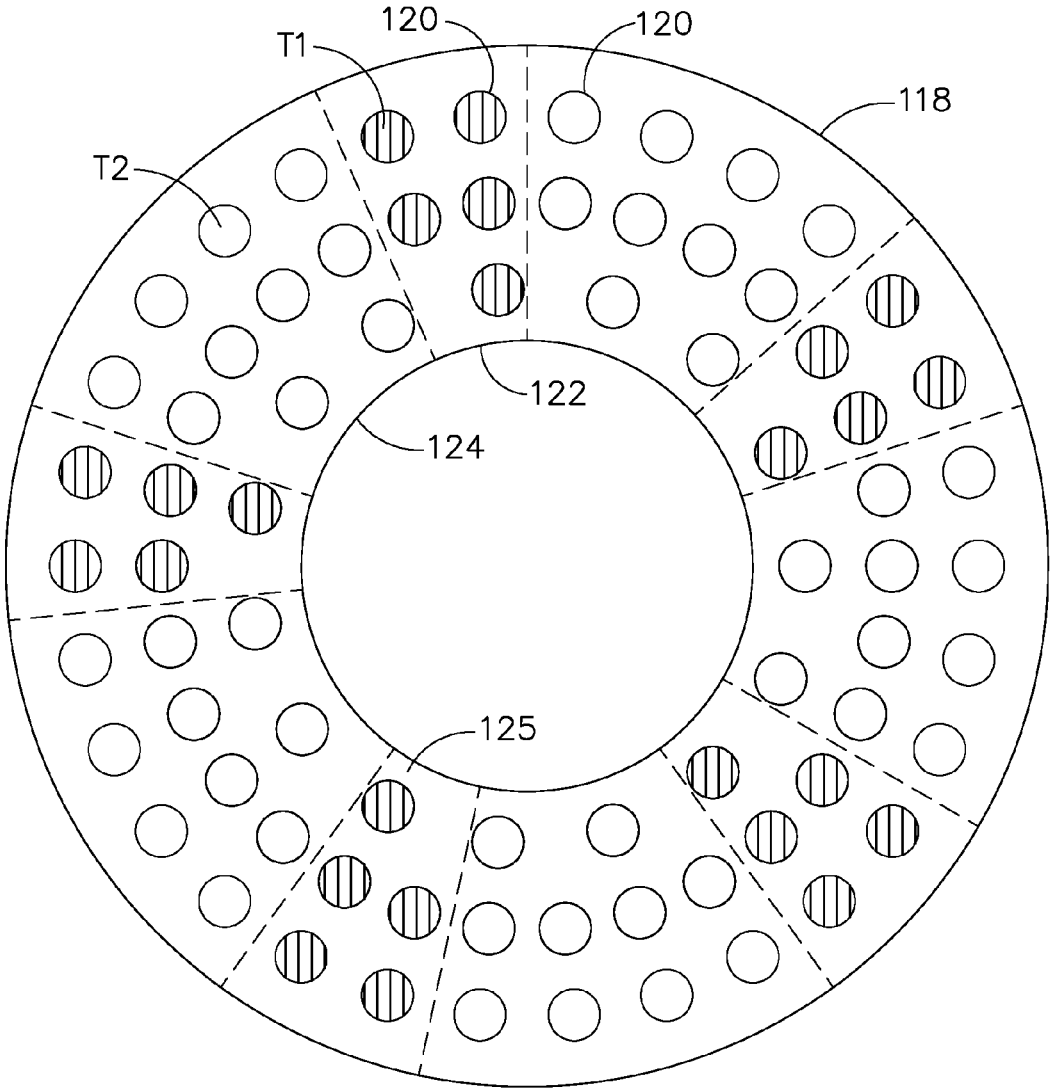
FIG. 7 is a schematical illustration of a sixth array of carburetors in burners to reduce or eliminate acoustics for a 5 per rev frequency in a gas turbine engine combustor with three annular rings of fuel injectors.

FIGS. 2 and 5 illustrate a combustor 10 with one circular row R of burners 120 and associated premixers 101 within the annulus 118, FIGS. 3 and 6 illustrate a combustor 10 with two circular rows R of burners 120 and associated premixers 101 within the annulus 118, and FIGS. 4 and 7 illustrate a combustor 10 with three circular rows R of burners 120 and associated premixers 101 within the annulus 118. FIGS. 5, 6, and 7 illustrate the combustor 10 having five first and second arcuate segments 122, 124 and one, two, and three circular rows R of burners 120 respectively and associated premixers 101 within the annulus 118 respectively.

Figure 8:
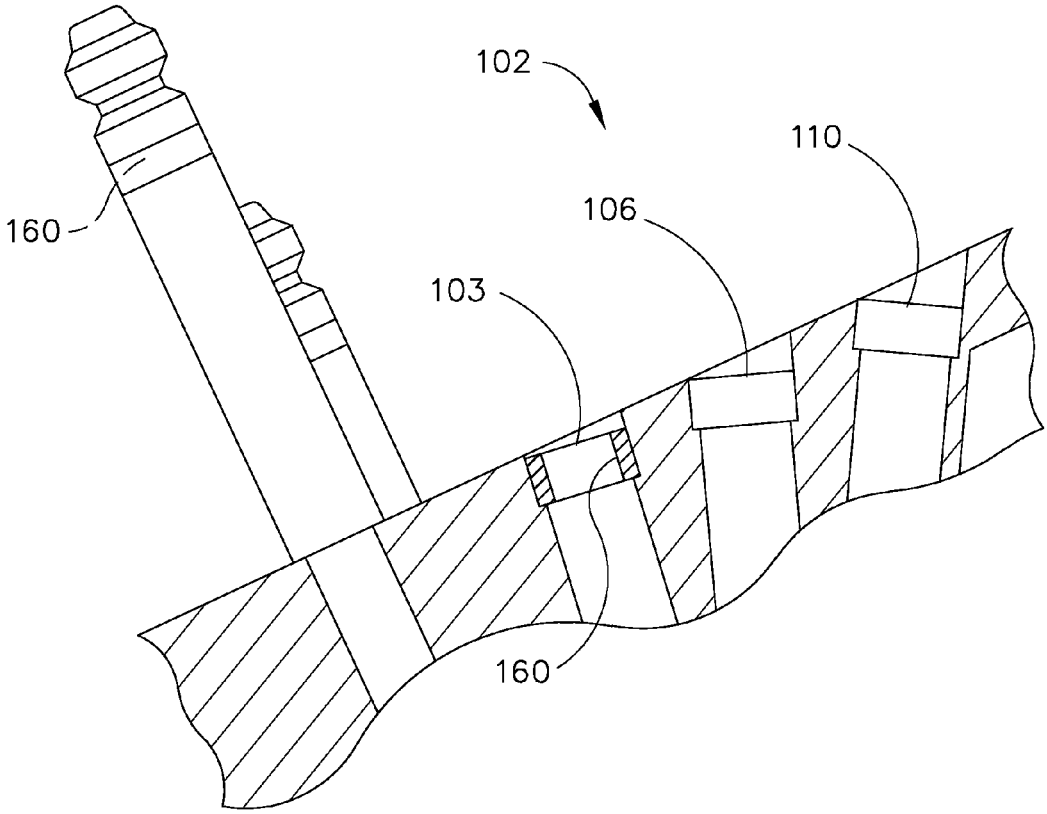
FIG. 8 is a cross-sectional view illustration of a metering orifice in a fuel line of the gas turbine engine combustor illustrated in FIG. 1.
Figure 9:
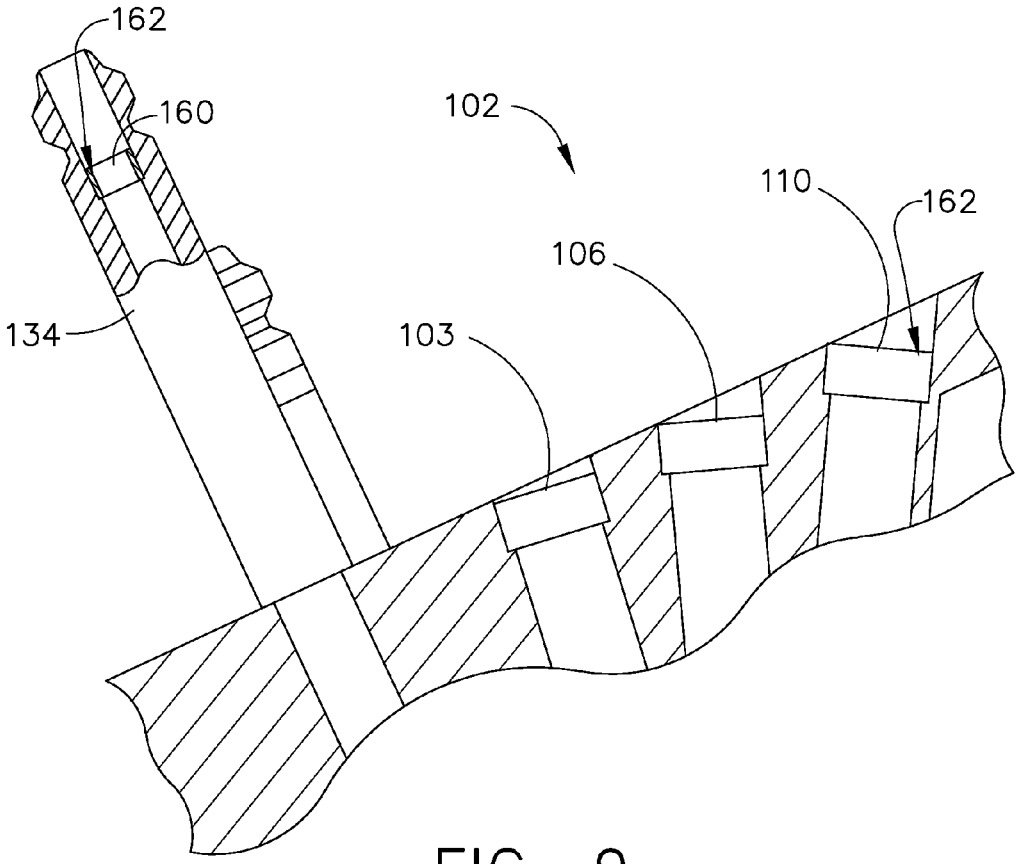
FIG. 9 is a cross-sectional view illustration of a metering orifice in a water line of the gas turbine engine combustor illustrated in FIG. 1.
Figure 10:
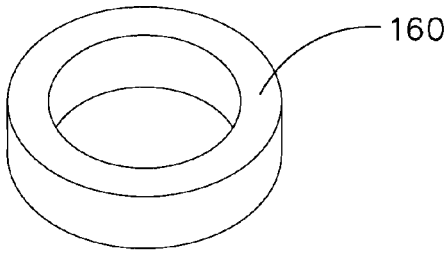
FIG. 10 is a perspective view illustration of the metering orifice illustrated in FIGS. 8 and 9.

There are various methods and means of providing the flame temperature nonuniformities 125 in the annulus 118 of burners 120. One of these means includes providing two different amounts of fuel and/or water flow going to the different burners 120. Another means includes supplying two different amounts of flow rates of fuel and/or water supplied to the burners 120 in the two different segments of the annulus 118 using the fuel and water supply pumps and controllers thereof. Yet another means includes setting two different amounts of flow rates of fuel and/or water supplied to the burners 120 in the two different first and second segments 122, 124 of the annulus 118 using passive means. One more specific means of accomplishing this is to put flow restrictors or metering orifices 160 into the fuel lines 102 and/or the water lines 148. The metering orifices 160 resemble a washer with a hole in the middle for flow restriction and are disposed in chambers 162 in the fuel lines 102 and/or the water lines 148 as illustrated in FIGS. 8-10.

While there have been described herein what are considered to be preferred and exemplary embodiments of the present invention, other modifications of the invention shall be apparent to those skilled in the art from the teachings herein and, it is therefore, desired to be secured in the appended claims all such modifications as fall within the true spirit and scope of the invention. Accordingly, what is desired to be secured by Letters Patent of the United States is the invention as defined and differentiated in the following claims.

The invention claimed is:

1. A gas turbine engine combustor comprising:

annular outer and inner liners and a domed end radially extending therebetween, the outer and inner liners spaced radially inwardly of an outer combustor casing, an annulus of burners supported by the domed end, the annulus including one or more circular rows of the burners, the annulus of the burners comprising an equal number of equiangular spaced apart first and second arcuate segments of the burners, fuel lines in fuel supply communication with and extending to the burners, means for providing a number of equiangular spaced apart flame temperature nonuniformities around the annulus during engine operation by flowing fuel to and combusting the fuel in all of the burners and restricting fuel flow to one or more restricted burners of the burners in each of the first arcuate segments of the burners, and the means including flow restrictors having fixed flow area metering orifices with unobstructed fixed flow areas metering orifices in the fuel lines to the one or more of the burners in each of the first arcuate segments of the burners.

2. The combustor as claimed in claim 1 further comprising the number of the flame temperature nonuniformities being equal to a circumferential acoustic mode to be attenuated in the combustor during engine operation.

3. The combustor as claimed in claim 2 further comprising the number of the flame temperature nonuniformities being equal to three, five, or seven.

4. The combustor as claimed in claim 3 further comprising the combustor having one, two, or three of the circular rows of the burners.

5. A gas turbine engine combustor comprising:

annular outer and inner liners and a domed end radially extending therebetween, the outer and inner liners spaced radially inwardly of an outer combustor casing, an annulus of burners supported by the domed end, the annulus including one or more circular rows of the burners, the annulus of the burners comprising an equal number of equiangular spaced apart first and second arcuate segments of the burners, fuel lines in fuel supply communication with and extending to the burners, water lines in supply communication with the burners, the means including flow restrictors in the fuel or water lines to the one or more restricted of the burners in the first arcuate segments operable for providing a number of equiangular spaced apart flame temperature nonuniformities around the annulus during engine operation, and the flow restrictors having fixed flow area metering orifices with unobstructed fixed flow areas in chambers in a portion of the fuel lines and/or the water lines.

6. The combustor as claimed in claim 5 further comprising the number of the flame temperature nonuniformities being equal to a circumferential acoustic mode to be attenuated in the combustor during engine operation.

7. The combustor as claimed in claim 6 further comprising the number of the flame temperature nonuniformities being equal to three, five, or seven.

8. The combustor as claimed in claim 7 further comprising one, two, or three of the circular rows of the burners.

9. A gas turbine engine combustor comprising:

an annulus of burners including one or more circular rows of the burners, the annulus of the burners comprising an equal number of equiangular spaced apart first and second arcuate segments of the burners, fuel lines in fuel supply communication with and extending to the burners, means for providing a number of equiangular spaced apart flame temperature nonuniformities around the annulus during engine operation by restricting fuel flow to one of the first and second arcuate segments of the burners, the means including flow restrictors in chambers in the fuel lines to at least one of the first and second arcuate segments of the burners for operating the first and second arcuate segments of the burners at different first and second flame temperatures respectively and the flow restrictors having fixed flow area metering orifices with unobstructed fixed flow areas in the fuel lines to the at least one of the first and second arcuate segments of the burners.

10. The combustor as claimed in claim 9 further comprising each of the first arcuate segments of the burners having a smaller quantity of the burners than the second arcuate segments of the burners.

11. The combustor as claimed in claim 10 further comprising the number of the first arcuate segments being equal to a circumferential acoustic mode to be attenuated in the combustor during engine operation.

12. The combustor as claimed in claim 11 further comprising the number of the first arcuate segments being equal to three, five, or seven.

13. The combustor as claimed in claim 12 further comprising the combustor having one, two, or three of the circular rows of the burners.

14. A gas turbine engine combustor comprising:

annular outer and inner liners and a domed end radially extending therebetween, the outer and inner liners spaced radially inwardly of an outer combustor casing, an annulus of burners of one or more circular rows of the burners supported by the domed end, the annulus of the burners comprising an equal number of equiangular spaced apart first and second arcuate segments of the burners, each of the first arcuate segments of the burners having a smaller quantity of the burners than the second arcuate segments of the burners, fuel lines in fuel supply communication with and extending to carburetors of the burners, water lines in supply communication with the carburetors, means for providing a number of equiangular spaced apart flame temperature nonuniformities around the annulus during engine operation by restricting fuel flow to one of the first and second arcuate segments of the burners, the means including flow restrictors in the fuel lines and/or the water lines for operating the first arcuate segments of the burners at a first flame temperature and operating the second arcuate segments of the burners at a second flame temperature different than the first flame temperature by restricting fuel and/or water flow to the fuel lines and/or the water lines respectively, and the flow restrictors having fixed flow area metering orifices with unobstructed fixed flow areas in the fuel lines and/or the water lines to the burners in the first arcuate segments of the burners.

15. The combustor as claimed in claim 14 further comprising the number of the first arcuate segments being equal to a circumferential acoustic mode to be attenuated in the combustor during engine operation.

16. The combustor as claimed in claim 15 further comprising the number of the first arcuate segments being equal to three, five, or seven.

17. The combustor as claimed in claim 16 further comprising one, two, or three of the circular rows of the burners.

18. A method for attenuating circumferential acoustics in a gas turbine engine combustor including annular outer and inner liners and a domed end radially extending therebetween wherein the outer and inner liners are spaced radially inwardly of an outer combustor casing, the method comprising:

operating the combustor with a number of equiangular spaced apart flame temperature nonuniformities around an annulus of burners supported by the domed end, the annulus including one or more circular rows of the burners, the number of the flame temperature nonuniformities being equal to a circumferential acoustic mode to be attenuated in the combustor during engine operation, the annulus of the burners comprising an equal number of equiangular spaced apart first and second arcuate segments of the burners, operating the first arcuate segments of the burners at a first flame temperature and operating the second arcuate segments of the burners at a second flame temperature different than the first flame temperature by restricting fuel flow to one of the first and second arcuate segments of the burners, and the restricting fuel flow to one of the first and second arcuate segments of the burners includes flowing fuel through flow restrictors in fuel lines to carburetors of the burners in the one of the first and second arcuate segments and the flow restrictors having fixed flow area metering orifices with unobstructed fixed flow areas.

19. The method as claimed in claim 18 further comprising the number of the flame temperature nonuniformities being equal to three, five, or seven and the combustor having one, two, or three of the circular rows of the burners.

20. The method as claimed in claim 18 further comprising each of the first arcuate segments of the burners having a smaller quantity of the burners than the second arcuate segments of the burners.

21. The method as claimed in claim 20 further comprising the number of the first arcuate segments being equal to three, five, or seven.

22. A method for attenuating circumferential acoustics in a gas turbine engine combustor including annular outer and inner liners and a domed end radially extending therebetween wherein the outer and inner liners are spaced radially inwardly of an outer combustor casing, the method comprising:

operating the combustor with a number of equiangular spaced apart flame temperature nonuniformities around an annulus of burners in the combustor, the annulus including one or more circular rows of the burners, the number of the flame temperature nonuniformities being equal to a circumferential acoustic mode to be attenuated in the combustor during engine operation, the annulus of the burners comprising an equal number of equiangular spaced apart first and second arcuate segments of the burners, flowing fuel through fuel lines extending to carburetors of the burners, flowing water through water lines to carburetors of the burners, operating the first arcuate segments of the burners at a first flame temperature and operating the second arcuate segments of the burners at a second flame temperature different than the first flame temperature by restricting fuel and/or water flow to the fuel lines and/or the water lines respectively, and using one or more fuel and water supply pumps controlled by one or more controllers for the restricting of fuel and/or water flow to the fuel lines and/or the water lines respectively.

23. The method as claimed in claim 22 further comprising the number of the first arucate segments being equal to a circumferential acoustic mode to be attenuated in the combustor during engine operation.

24. The method as claimed in claim 23 further comprising the number of the first arucate segments being equal to three, five, or seven.

25. A method for attenuating circumferential acoustics in a gas turbine engine combustor including annular outer and inner liners and a domed end radially extending therebetween wherein the outer and inner liners are spaced radially inwardly of an outer combustor casing, the method comprising:

operating the combustor with a number of equiangular spaced apart flame temperature nonuniformities around an annulus of burners in the combustor, the annulus including one or more circular rows of the burners, the number of the flame temperature nonuniformities being equal to a circumferential acoustic mode to be attenuated in the combustor during engine operation, the annulus of the burners comprising an equal number of equiangular spaced apart first and second arcuate segments of the burners, flowing fuel through fuel lines extending to carburetors of the burners, flowing water through water lines to carburetors of the burners, operating the first arcuate segments of the burners at a first flame temperature and operating the second arcuate segments of the burners at a second flame temperature different than the first flame temperature by restricting fuel and/or water flow to the fuel lines and/or the water lines respectively, using one or more fuel and water supply pumps controlled by one or more controllers for the restricting of fuel and/or water flow to the fuel lines and/or the water lines respectively, the restricting fuel and/or water flow to the fuel lines and/or the water lines respectively including flowing the fuel and/or water flow through flow restrictors in the fuel lines and/or the water lines to the carburetors of the burners in only the first arcuate segments, the flow restrictors having fixed flow area metering orifices, and the flow restrictors disposed in chambers in the fuel lines and/or the water lines to the carburetors of the burners in only the first arcuate segments.

26. The method as claimed in claim 18 further comprising each of the first arcuate segments of the burners having a smaller quantity of the burners than the second arcuate segments of the burners and the number of the first arcuate segments being equal to three, five, or seven.

27. The method as claimed in claim 18 further comprising using one or more fuel supply pumps controlled by one or more controllers for the restricting of fuel flow to one of the first and second arcuate segments of the burners.

* * * * *

UNITED STATES PATENT AND TRADEMARK OFFICE

CERTIFICATE OF CORRECTION

PATENT NO. : 8,631,656 B2
APPLICATION NO. : 12/059256
DATED : January 21, 2014
INVENTOR(S) : Danis et al.

It is certified that error appears in the above-identified patent and that said Letters Patent is hereby corrected as shown below:

In the Specification

In Column 6, Lines 55-56, delete "restrictors or metering" and
insert -- restrictors 59 having unobstructed fixed flow area A metering --, therefor.

In Column 6, Line 57, delete "The metering" and insert -- The flow restrictors 59 with unobstructed fixed flow area metering --, therefor.

In the Claims

In Column 10, Line 19, in Claim 23, delete "arucate" and insert -- arcuate --, therefor.

In Column 10, Line 23, in Claim 24, delete "arucate" and insert -- arcuate --, therefor.

Signed and Sealed this
Twenty-eighth Day of April, 2015

Michelle K. Lee

Michelle K. Lee
*Director of the United States Patent and Trademark Office*